US010385692B2

(12) United States Patent
Zhang et al.

(10) Patent No.: US 10,385,692 B2
(45) Date of Patent: Aug. 20, 2019

(54) APPARATUS AND METHOD FOR PRE-LOADING MECHANICAL CONSTANT-RESISTANCE SINGLE PROP

(71) Applicant: China University of Mining and Technology, Jiangsu (CN)

(72) Inventors: Jixiong Zhang, Jiangsu (CN); Qiang Zhang, Jiangsu (CN); Yanlong Chen, Jiangsu (CN); Kai Quan, Jiangsu (CN); Hao Yan, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/088,452

(22) PCT Filed: Dec. 1, 2016

(86) PCT No.: PCT/CN2016/108257

§ 371 (c)(1),
(2) Date: Sep. 26, 2018

(87) PCT Pub. No.: WO2018/082148

PCT Pub. Date: May 11, 2018

(65) Prior Publication Data

US 2019/0085690 A1 Mar. 21, 2019

(30) Foreign Application Priority Data

Nov. 3, 2016 (CN) ..... 2016 1 0957619

(51) Int. Cl.
*E21D 15/502* (2006.01)
*E21D 15/02* (2006.01)
(Continued)

(52) U.S. Cl.
CPC ..... *E21D 15/502* (2013.01); *E21D 15/02* (2013.01); *E21D 15/50* (2013.01); *E21D 15/54* (2013.01); *B66F 3/12* (2013.01); *B66F 3/22* (2013.01)

(58) Field of Classification Search
CPC ..... B66F 3/22; B66F 3/08; B66F 3/12; E21D 15/32–589; F16L 1/10; Y10T 29/53796;
(Continued)

(56) References Cited

U.S. PATENT DOCUMENTS 1,587,689 A * 6/1926 Weiss ..... B25B 27/00 254/29 R
6,234,541 B1 * 5/2001 Wagner ..... F01N 13/1805 24/277
(Continued)

FOREIGN PATENT DOCUMENTS

CN 2166227 5/1994
CN 101793155 8/2010
(Continued)

OTHER PUBLICATIONS

"International Search Report (Form PCT/ISA/210)", dated Aug. 7, 2017, with English translation thereof, pp. 1-4.

*Primary Examiner* — Tyrone V Hall, Jr.
(74) *Attorney, Agent, or Firm* — JCIPRNET

(57) ABSTRACT

An apparatus for pre-loading a mechanical constant-resistance single prop includes a rhombic stretchable bracket, a screw rod, a first cylindrical sleeve ring, and a second cylindrical sleeve ring. The screw rod is connected to two opposite apex corners of the rhombic stretchable bracket. A tail end of the screw rod is fixedly connected to one apex corner of the rhombic stretchable bracket. An end head of the screw rod passes through another apex corner of the rhombic stretchable bracket. The remaining two opposite apex corners of the rhombic stretchable bracket are respectively fixedly connected to edges of the first cylindrical sleeve ring and the second cylindrical sleeve ring through connecting rods. The screw rod is threadedly connected to the apex corner of the rhombic stretchable bracket through which the screw rod passes. A method for pre-loading a mechanical constant-resistance single prop is also provided.

8 Claims, 1 Drawing Sheet

(51) Int. Cl.

| | |
|---|---|
| ***E21D 15/54*** | (2006.01) |
| ***E21D 15/50*** | (2006.01) |
| ***B66F 3/22*** | (2006.01) |
| ***B66F 3/12*** | (2006.01) |

(58) Field of Classification Search
CPC ..... Y10T 29/53848; Y10T 29/53857; Y10T 29/53913–53917
See application file for complete search history.

(56) References Cited

U.S. PATENT DOCUMENTS

| | | | | |
|---|---|---|---|---|
| 6,571,426 | B2 * | 6/2003 | Chen | A47B 61/003 16/87 R |
| 6,612,803 | B1 * | 9/2003 | McCartney | B66F 9/18 294/104 |
| 2001/0003225 | A1 * | 6/2001 | Stephen | F16L 1/10 29/272 |
| 2004/0223815 | A1 * | 11/2004 | Stankus | E21D 15/325 405/288 |
| 2006/0016296 | A1 * | 1/2006 | Sinanan | B25B 13/461 81/60 |
| 2006/0097235 | A1 * | 5/2006 | Wu | B25F 3/00 254/126 |
| 2012/0148350 | A1 | 6/2012 | Poulson et al. | |
| 2013/0039704 | A1 * | 2/2013 | Kashyap | E21D 15/46 405/290 |

FOREIGN PATENT DOCUMENTS

| | | |
|---|---|---|
| CN | 202039875 | 11/2011 |
| CN | 103758543 | 4/2014 |
| CN | 203702197 | 7/2014 |
| CN | 104929663 | 9/2015 |

* cited by examiner

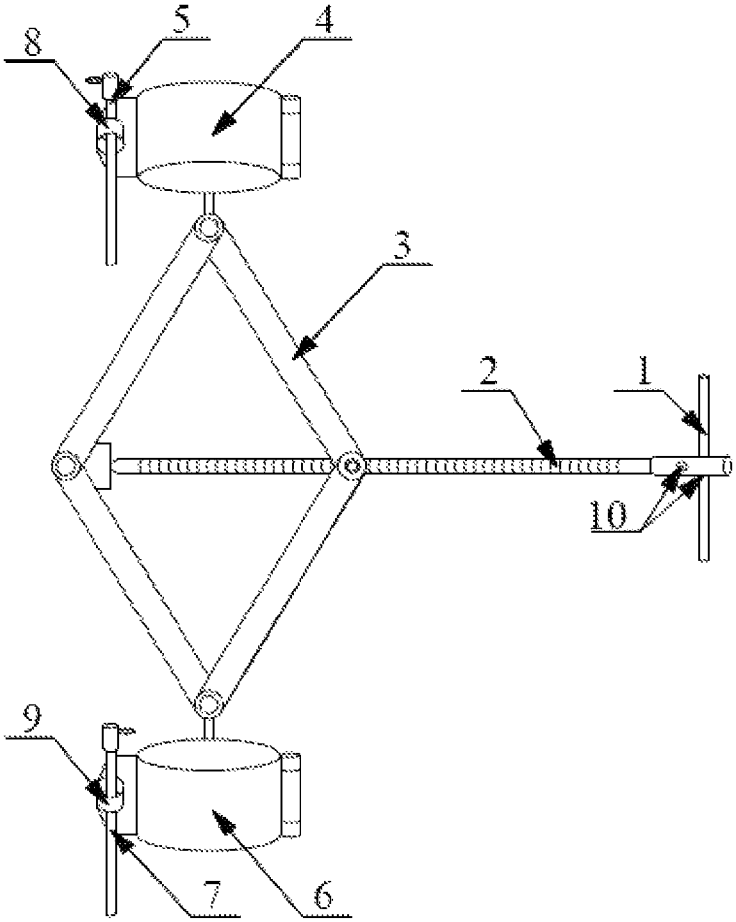
8
5
4
3
2
1
10
9
7
6

APPARATUS AND METHOD FOR PRE-LOADING MECHANICAL CONSTANT-RESISTANCE SINGLE PROP

CROSS-REFERENCE TO RELATED APPLICATION

This is a 371 application of the International PCT application serial no. PCT/CN2016/108257, filed on Dec. 1, 2016, which claims the priority benefits of China Application No. 201610957619.0, filed on Nov. 3, 2016. The entirety of each of the above-mentioned patent applications is hereby incorporated by reference herein and made a part of this specification.

BACKGROUND OF THE INVENTION

Field of the Invention

The present invention relates to a technical field of mechanical engineering, and in particular, to an apparatus and a method for pre-loading a mechanical constant-resistance single prop.

Description of Related Art

Prestressed single props are widely applied in the field of engineering. Currently, single props used for support of coal mines are usually insufficiently prestressed, and apparatuses are relatively complex and have poor stability. For a metal friction prop, there are problems such as difficulty in prestressing.

Therefore, according to current situation of current supporting equipment, it is of great significance to bring innovation to single supporting equipment in use.

SUMMARY OF THE INVENTION

An objective of the present invention is to provide an apparatus and a method for pre-loading a mechanical constant-resistance single prop, so as to resolve the foregoing problem that exists in the prior art, so that the apparatus can achieve objectives of prestressing of the single prop, a simple structure, and a convenient operation, and has a wide practicability.

To achieve the foregoing objectives, the present invention provides following solutions:

The present invention provides an apparatus for pre-loading a mechanical constant-resistance single prop, which includes a rhombic stretchable bracket, a screw rod, a first cylindrical sleeve ring, and a second cylindrical sleeve ring. The screw rod is connected to two opposite apex corners of the rhombic stretchable bracket. A tail end of the screw rod is fixedly connected to one apex corner of the rhombic stretchable bracket. An end head of the screw rod passes through another apex corner of the rhombic stretchable bracket. The remaining two opposite apex corners of the rhombic stretchable bracket are respectively fixedly connected to edges of the first cylindrical sleeve ring and the second cylindrical sleeve ring through connecting rods. The screw rod is threadedly connected to the apex corner of the rhombic stretchable bracket that the screw rod passes therethrough.

Optionally, the rhombic stretchable bracket is formed of four rod pieces rotatably connected end-to-end.

Optionally, a rotary handle is fixedly connected to the end head of the screw rod.

Optionally, two holes are disposed at the end head of the screw rod. The rotary handle is inserted into the two holes for fixing to the screw rod.

Optionally, axes of the two holes are perpendicular to each other.

Optionally, the first cylindrical sleeve ring is an openable sleeve ring, and has one side of the first cylindrical sleeve ring fixedly connected through a rotating shaft, and another side having a first pin hole disposed thereon. The first cylindrical sleeve ring is closed via connection of a first pin to the first pin hole, and is opened via disconnection of the first pin from the first pin hole.

Optionally, the second cylindrical sleeve ring is an openable sleeve ring, and has one side of the second cylindrical sleeve ring fixedly connected through a rotating shaft, and another side having a second pin hole disposed thereon. The second cylindrical sleeve ring is closed via connection of a second pin to the second pin hole, and is opened via disconnection of the second pin from the second pin hole.

The present invention further provides a method for pre-loading a mechanical constant-resistance single prop, including following steps:

during pre-stressing, turning a rotary handle to increase a length of a screw rod between two opposite apex corners of a rhombic stretchable bracket, so as to reduce a distance between a first cylindrical sleeve ring and a second cylindrical sleeve ring;

removing a first pin and a second pin, so as to allow the first cylindrical sleeve ring and the second cylindrical sleeve ring to be in an opened state;

sleeving two halves of the first cylindrical sleeve ring and two halves of the second cylindrical sleeve ring respectively over an upper portion and a lower portion of a cylinder body of a single prop;

inserting the first pin and the second pin in a first pin hole and a second pin hole respectively, and closing and locking the first cylindrical sleeve ring and the second cylindrical sleeve ring; and reversely turning the rotary handle to reduce the length of the screw rod between the two opposite apex corners of the rhombic stretchable bracket, so that the distance between the first cylindrical sleeve ring and the second cylindrical sleeve ring is increased, the cylinder body of the single prop that is tightly held by the two cylindrical sleeve rings rises, thus the single prop has a certain prepressure.

In Comparison with the prior art, the present invention achieves following technical effects.

The present apparatus can exert a pre-stress on the constant-resistance single prop by applying a force by means of a rotary handle and the screw rod, so as to increase or decrease a distance between diagonal points of the rhombic stretchable bracket, thereby increasing or decreasing the distance between the first cylindrical sleeve ring and the second cylindrical sleeve ring, so as to achieve the purpose of exerting the pre-stress on the constant-resistance single prop. Moreover, the apparatus has a simple structure, is easy to operate, has good effects, and is widely applicable.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show some embodiments of the present invention, and persons of ordinary skill in the art may still derive other drawings from these accompanying drawings without creative efforts.

FIG. 1 is a schematic diagram of an overall structure of a pre-loading apparatus according to the present invention.

Wherein, rotary handle; 2, screw rod; 3, rhombic stretchable bracket; 4, first cylindrical sleeve ring; 5, first pin; 6, second cylindrical sleeve ring; 7, second pin; 8, first pin hole; 9, second pin hole; 10, hole.

DETAILED DESCRIPTION OF THE INVENTION

The technical solutions according to the embodiments of the present invention are clearly and thoroughly described with reference to the accompanying drawings in the embodiments of the present invention. The described embodiments are merely exemplary ones, but are not all the embodiments of the present invention. Based on the embodiments of the present invention, all other embodiments derived by persons of ordinary skill in the art without any creative efforts shall fall within the protection scope of the present invention.

An objective of the present invention is to provide an apparatus and a method for pre-loading a mechanical constant-resistance single prop, so as to resolve the foregoing problem that exists in the prior art, so that the apparatus can achieve objectives of prestressing of the single prop, a simple structure, and a convenient operation, and has a wide practicability.

An apparatus for pre-loading a mechanical constant-resistance single prop in the present invention includes a rhombic stretchable bracket, a screw rod, a first cylindrical sleeve ring, and a second cylindrical sleeve ring. The screw rod is connected to two opposite apex corners of the rhombic stretchable bracket. A tail end of the screw rod is fixedly connected to one apex corner of the rhombic stretchable bracket. An end head of the screw rod passes through another apex corner of the rhombic stretchable bracket. The remaining two opposite apex corners of the rhombic stretchable bracket are respectively fixedly connected to edges of the first cylindrical sleeve ring and the second cylindrical sleeve ring through connecting rods. The screw rod is threadedly connected to the apex corner of the rhombic stretchable bracket that the screw rod passes therethrough.

The present invention further provides a method for pre-loading a mechanical constant-resistance single prop, including the following steps.

(1) When prestressing needs to be performed, turning a screw rod to increase a length of the screw rod between two opposite apex corners of a rhombic stretchable bracket, so as to reduce a distance between the first cylindrical sleeve ring and the second cylindrical sleeve ring.

(2) Opening the first cylindrical sleeve ring and the second cylindrical sleeve ring.

(3) Sleeving two halves of the first cylindrical sleeve ring and two halves of the second cylindrical sleeve ring respectively over an upper portion and a lower portion of a cylinder body of the single prop.

(4) Closing the first cylindrical sleeve ring and the second cylindrical sleeve ring, and locking up the two cylindrical sleeve rings, so that the first cylindrical sleeve ring and the second cylindrical sleeve ring tightly hold the upper portion and the lower portion of the cylinder body of the single prop.

(5) Reversely turning the screw rod to reduce the length of the screw rod between the two opposite apex corners of the rhombic stretchable bracket, so that the distance between the first cylindrical sleeve ring and the second cylindrical sleeve ring is increased. The cylinder body of the single prop that is tightly held by the two cylindrical sleeve rings rises, thus the single prop has a certain prepressure.

To make the aforesaid objectives, features, and advantages of the present invention more clearly, the present invention is further described below in detail with reference to the accompanying drawings and specific implementation manners.

Referring to FIG. 1, wherein, FIG. 1 is a schematic diagram of an overall structure of a pre-loading apparatus according to the present invention.

As shown in FIG. 1, this embodiment provides an apparatus for pre-loading a mechanical constant-resistance single prop, which includes a rhombic stretchable bracket 3, a screw rod 2, a first cylindrical sleeve ring 4, and a second cylindrical sleeve ring 6. The screw rod 2 is connected to two opposite apex corners of the rhombic stretchable bracket 3. A tail end of the screw rod 2 is fixedly connected to one apex corner of the rhombic stretchable bracket 3. An end head of the screw rod 2 passes through another apex corner of the rhombic stretchable bracket 3. The remaining two opposite apex corners of the rhombic stretchable bracket 3 are respectively fixedly connected to edges of the first cylindrical sleeve ring 4 and the second cylindrical sleeve ring 6 through connecting rods. The screw rod 2 is threadedly connected to the apex corner of the rhombic stretchable bracket 3 that the screw rod 2 passes therethrough.

The rhombic stretchable bracket 3 is formed of four rod pieces rotatably connected end-to-end.

A rotary handle 1 is fixedly connected to the end head of the screw rod 2. Two holes 10 are disposed at the end head of the screw rod 2. The rotary handle 1 is inserted in the two holes 10 and is fixed to the screw rod 2. An operator turns the rotary handle 1 to move the screw rod 2. Axes of the two holes 10 at the end head of the screw rod 2 are perpendicular to each other, so as to facilitate insertion of the rotary handle 1.

The first cylindrical sleeve ring 4 is an openable sleeve ring, and has one side of the first cylindrical sleeve ring fixedly connected through a rotating shaft, and another side having a first pin hole 8 disposed thereon. A first pin 5 and the first pin hole 8 are connected and separated to control the first cylindrical sleeve ring 4 to be closed and opened.

The second cylindrical sleeve ring 6 is an openable sleeve ring, and has one side of the second cylindrical sleeve ring fixedly connected through a rotating shaft, and another side having a second pin hole 9 disposed thereon. A second pin 7 and the second pin hole 9 are connected and separated to control the second cylindrical sleeve ring 6 to be closed and opened.

The present invention further provides a method for pre-loading a mechanical constant-resistance single prop. Based on the foregoing apparatus for pre-loading a mechanical constant-resistance single prop, the method includes following steps.

(1) When prestressing needs to be performed, turning the rotary handle 1 to increase a length of the screw rod 2 between two opposite apex corners of the rhombic stretchable bracket 3, so as to reduce a distance between the first cylindrical sleeve ring 4 and the second cylindrical sleeve ring 6.

(2) Removing a first pin 5 and a second pin 7, so as to enable the first cylindrical sleeve ring 4 and the second cylindrical sleeve ring 6 to be in an opened state.

(3) Sleeving two halves of the first cylindrical sleeve ring 4 and two halves of the second cylindrical sleeve ring 6 respectively over an upper portion and a lower portion of a cylinder body of the single prop.

(4) Closing the first cylindrical sleeve ring 4 and the second cylindrical sleeve ring 6. Inserting the first pin 5 and the second pin 7 back in the first pin hole 8 and the second pin hole 9 respectively. Locking up the first cylindrical sleeve ring 4 and the second cylindrical sleeve ring 6, so that the first cylindrical sleeve ring 4 and the second cylindrical sleeve ring 6 tightly hold the upper portion and the lower portion of the cylinder body of the single prop.

(5) Reversely turning the rotary handle 1 to reduce the length of the screw rod 2 between the two opposite apex corners of the rhombic stretchable bracket 3, so that the distance between the first cylindrical sleeve ring 4 and the second cylindrical sleeve ring 6 is increased. The cylinder body of the single prop that is tightly held by the two cylindrical sleeve rings rises, thus the single prop has a certain prepressure.

Although the principle and implementation of the present invention are described by using specific examples in the invention, descriptions of the embodiments are merely intended to help understand the methods and core idea of the present invention. Meanwhile, variations may be made to the specific implementation and application scope by persons of ordinary skill in the art according to the idea of the present invention. Therefore, the content of this specification shall not be construed as a limitation to the present invention.

What is claimed is:

1. An apparatus for pre-loading a mechanical constant-resistance single prop, the apparatus comprising a rhombic stretchable bracket, a screw rod, a first cylindrical sleeve ring, and a second cylindrical sleeve ring, the screw rod is connected to two opposite apex corners of the rhombic stretchable bracket, a tail end of the screw rod is fixedly connected to one apex corner of the rhombic stretchable bracket, an end head of the screw rod passes through another apex corner of the rhombic stretchable bracket, the remaining two opposite apex corners of the rhombic stretchable bracket are respectively fixedly connected to edges of the first cylindrical sleeve ring and the second cylindrical sleeve ring through connecting rods, and the screw rod is threadedly connected to the apex corner of the rhombic stretchable bracket that the screw rod passes therethrough.

2. The apparatus for pre-loading a mechanical constant-resistance single prop according to claim 1, wherein the rhombic stretchable bracket is formed of four rod pieces rotatably connected end-to-end.

3. The apparatus for pre-loading a mechanical constant-resistance single prop according to claim 1, wherein a rotary handle is fixedly connected to the end head of the screw rod.

4. The apparatus for pre-loading a mechanical constant-resistance single prop according to claim 1, wherein two holes are disposed at the end head of the screw rod, and a rotary handle is inserted into the two holes for fixing to the screw rod.

5. The apparatus for pre-loading a mechanical constant-resistance single prop according to claim 4, wherein axes of the two holes are perpendicular to each other.

6. The apparatus for pre-loading a mechanical constant-resistance single prop according to claim 1, wherein the first cylindrical sleeve ring is an openable sleeve ring, and has one side fixedly connected through a rotating shaft, and another side having a first pin hole disposed thereon, and the first cylindrical sleeve ring is closed via connection of a first pin to the first pin hole, and is opened via disconnection of the first pin from the first pin hole.

7. The apparatus for pre-loading a mechanical constant-resistance single prop according to claim 1, wherein the second cylindrical sleeve ring is an openable sleeve ring, and has one side fixedly connected through a rotating shaft, and another side having a second pin hole disposed thereon, and the second cylindrical sleeve ring is closed via connection of a second pin to the second pin hole, and is opened via disconnection of the second pin from the second pin hole.

8. A method for pre-loading a mechanical constant-resistance single prop, the method comprising following steps:

during pre-stressing, turning a rotary handle to increase a length of a screw rod between two opposite apex corners of a rhombic stretchable bracket, so as to reduce a distance between a first cylindrical sleeve ring and a second cylindrical sleeve ring;

removing a first pin and a second pin, so as to allow the first cylindrical sleeve ring and the second cylindrical sleeve ring to be in an opened state;

sleeving two halves of the first cylindrical sleeve ring and two halves of the second cylindrical sleeve ring respectively over an upper portion and a lower portion of a cylinder body of a single prop;

inserting the first pin and the second pin in a first pin hole and a second pin hole respectively, and closing and locking the first cylindrical sleeve ring and the second cylindrical sleeve ring; and reversely turning the rotary handle to reduce the length of the screw rod between the two opposite apex corners of the rhombic stretchable bracket, so that the distance between the first cylindrical sleeve ring and the second cylindrical sleeve ring is increased, the cylinder body of the single prop that is tightly held by the two cylindrical sleeve rings rises, thus the single prop has a certain prepressure.

* * * * *